US007175469B1

(12) United States Patent
Daily et al.

(10) Patent No.: US 7,175,469 B1
(45) Date of Patent: Feb. 13, 2007

(54) CONNECTOR HAVING DUAL TABBED WIRE TRAP

(75) Inventors: Christopher G. Daily, Harrisburg, PA (US); Scott S. Duesterhoeft, Etters, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/459,160

(22) Filed: Jul. 21, 2006

(51) Int. Cl.
*H01R 4/24* (2006.01)

(52) U.S. Cl. ..... 439/441

(58) Field of Classification Search ..... 439/436–441
See application file for complete search history.

(56) References Cited

U.S. PATENT DOCUMENTS

| | | | | |
|---|---|---|---|---|
| 5,061,203 | A * | 10/1991 | Allgood et al. | 439/441 |
| 6,012,944 | A * | 1/2000 | Hatakeyama | 439/441 |
| 6,080,008 | A * | 6/2000 | Frantz | 439/441 |
| 6,336,824 | B1 * | 1/2002 | Sorig | 439/441 |
| 6,570,306 | B2 * | 5/2003 | Henrici et al. | 313/318.01 |
| 6,719,581 | B2 * | 4/2004 | Kikuchi | 439/441 |
| 6,981,890 | B2 * | 1/2006 | Cutler et al. | 439/441 |
| 7,004,781 | B2 * | 2/2006 | Walter | 439/441 |
| 7,083,463 | B2 * | 8/2006 | Steinkemper et al. | 439/441 |
| 7,114,986 | B1 * | 10/2006 | Toly | 439/441 |
| 2004/0248457 | A1 * | 12/2004 | Walter | 439/441 |
| 2006/0063419 | A1 * | 3/2006 | Steinkemper et al. | 439/441 |

OTHER PUBLICATIONS

Photographs of photoelectric connector marked "General Electric", Area Lighting Research part No. 8-1199069-7.
"Receptacle, Twist Lock," Drawing No. 63863, Tyco Electronics Corp., Harrisburg, PA (Jun. 16, 2004).
"Contact, Receptacle," Drawing No. 050-202, Area Lighting Research (Sep. 3, 1993).
"Housing, Recept. T'Lock," Drawing No. 008-080, Area Lighting Research, date unknown.

* cited by examiner

*Primary Examiner*—Ross Gushi

(57) ABSTRACT

A connector having a contact including a dual-tabbed wire trap is disclosed. The wire trap includes a first wire retention tab and a second wire retention tab, wherein the wire retention tabs are biased toward one another at an angle to form a wire guide. The wire guide is configured to contact and receive a wire inserted into the wire trap. When the wire is inserted, the first and second wire retention tabs impart a clamping force to retain the wire in the wire trap and prevent its removal. According to one embodiment, the connector is a photoelectric connector for attaching a street lamp or other electrical device to a photoelectric cell.

18 Claims, 8 Drawing Sheets

CONNECTOR HAVING DUAL TABBED WIRE TRAP

FIELD OF THE INVENTION

The present invention is directed to a connector and more particularly to a connector having a dual-tabbed wire trap.

BACKGROUND OF THE INVENTION

Many outdoor lighting devices, such as street lamps, are operated from dusk until dawn using photoelectric cells having control units in electrical communication with the lamp. The control unit closes a switch and turns on the lamp when the intensity of incident light falling on a photoelectric sensor is below a pre-set value and turns off the lamp when the intensity of the light is above another pre-set value. Such control units are generally attached to the lamp using a connector that provides electrical contact between the photoelectric cell and the lamp, as well as physically attaching the photoelectric cell to the lamp.

Current connectors for use in these applications have a number of drawbacks. For example, current connectors require that wires leading to the lamp be crimped into a wire retention portion of the connector prior to final assembly of the connector. This makes assembly and installation more cumbersome and time consuming. Thus, the connector cannot be finally assembled until the installation site, unless the connector is assembled with the wires already attached, in which case the connector includes wires that must be wired to the lamp at the installation site.

Also, current connectors typically require multiple parts, in which the connector is attached to the lamp using a steel spring clip or some other snap-on type of clip that is separate from the connector and which must be separately manufactured, provided and assembled.

Furthermore, photoelectric cells are typically positioned to face a certain direction to uniformly control the amount of incident light hitting the photoelectric cell at various times of the day, and thus better control lamp operation. As a result, the cells typically need to be adjusted at the installation site, but once adjusted to a desired orientation, they remain at that position. However, current connectors do not adequately provide for these adjustments without lifting the entire connector from its current position and reinserting it at a new position.

These and other drawbacks are found in current photoelectric connectors.

What is needed is a connector that more provides for retention of wires without crimping and which provides for easier connector assembly. What is also needed is a photoelectric connector that can be more easily manufactured and assembled and which more easily permits adjustments in orientation at the installation site.

SUMMARY OF THE INVENTION

According to one exemplary embodiment of the invention, a connector is disclosed. The connector comprises a connector body portion having an upper body portion with a top surface and at least one prong receptacle extending therethrough and a lower body portion with at least one contact receptacle extending therethrough. The lower body portion projects away from the upper body portion at substantially a right angle from a plane that includes the top surface of the upper body portion. The connector further comprises at least one conductive contact retained in the contact receptacle comprising a wire trap for receiving and retaining a wire of a first device to be connected to a second device, wherein the connector body portion comprises an integral retention system for retaining the connector in at least one of the first device or the second device.

According to another exemplary embodiment of the invention, a connector comprises a connector body portion and at least one conductive contact retained within an aperture of the connector body portion for receiving and retaining a wire of a first device to be connected. The contact comprises a wire trap having a first wire retention tab and a second wire retention tab, wherein the first wire retention tab and the second wire retention tab are biased toward one another at an angle to form a wire guide, the wire guide configured to contact and receive a wire inserted into the wire trap and wherein the first and second wire retention tabs are configured to impart a clamping force to retain the wire, when inserted, in the wire trap.

One advantage found in exemplary embodiments of the invention is that a connector having a dual-tabbed poke-in wire trap avoids the need to crimp wires in order to retain them in the connector. Thus, unlike current connectors that require crimping before final assembly, using a dual-tabbed poke-in wire trap permits final assembly of the connector irrespective of wire crimping operation.

Another advantage of exemplary embodiments of the invention is the elimination of spring clips or other separate retaining devices needed to physically attach the connector to an electrical device through the inclusion of an integral retention system.

Yet another advantage of exemplary embodiments of the invention includes providing a connector that is easily adjustable at the installation site for positioning a photoelectric cell at a desired orientation.

Other features and advantages of the present invention will be apparent from the following more detailed description of exemplary embodiments, taken in conjunction with the accompanying drawings which illustrate, by way of example, the principles of the invention.

BRIEF DESCRIPTION OF THE DRAWINGS

Where like parts appear in more than one drawing, it has been attempted to use like reference numerals for clarity.

DETAILED DESCRIPTION OF EXEMPLARY EMBODIMENTS

Figure 1:
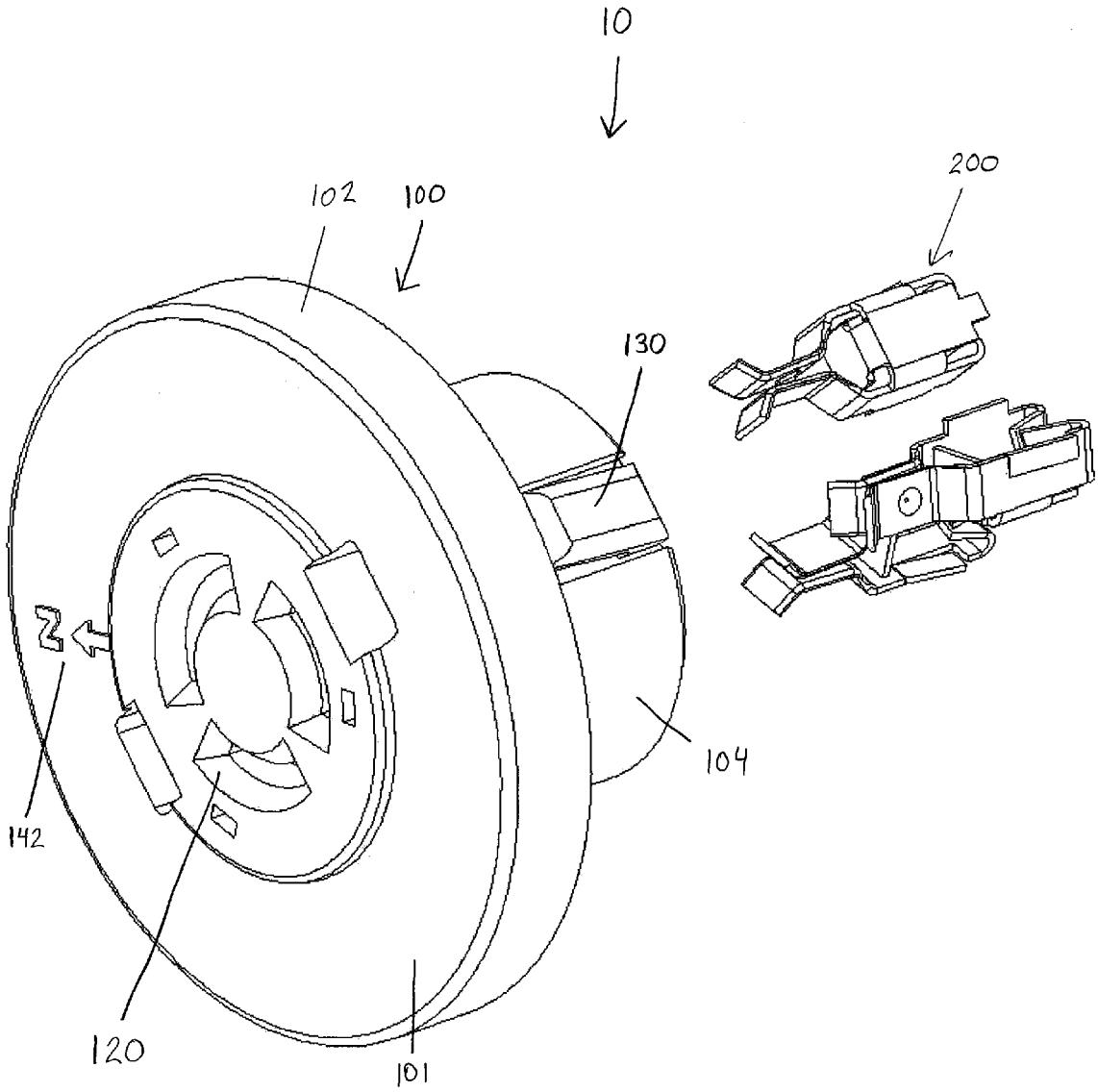
FIG. 1 illustrates an exploded view of a photoelectric connector in accordance with an exemplary embodiment of the invention.

FIG. 1 illustrates an exploded view of a connector 10 that comprises a connector body portion 100 and one or more contacts 200. As illustrated in FIG. 1, the connector 10 is a photoelectric connector for use in connecting a photoelectric cell to an electric device, such as a street lamp. The contact 200 is constructed of an electrically conductive material, typically copper alloy, and accomplishes the actual electrical connection between two devices to complete an electrical circuit. The contact 200 is retained in the connector 10 by the connector body portion 100.

Figure 6:
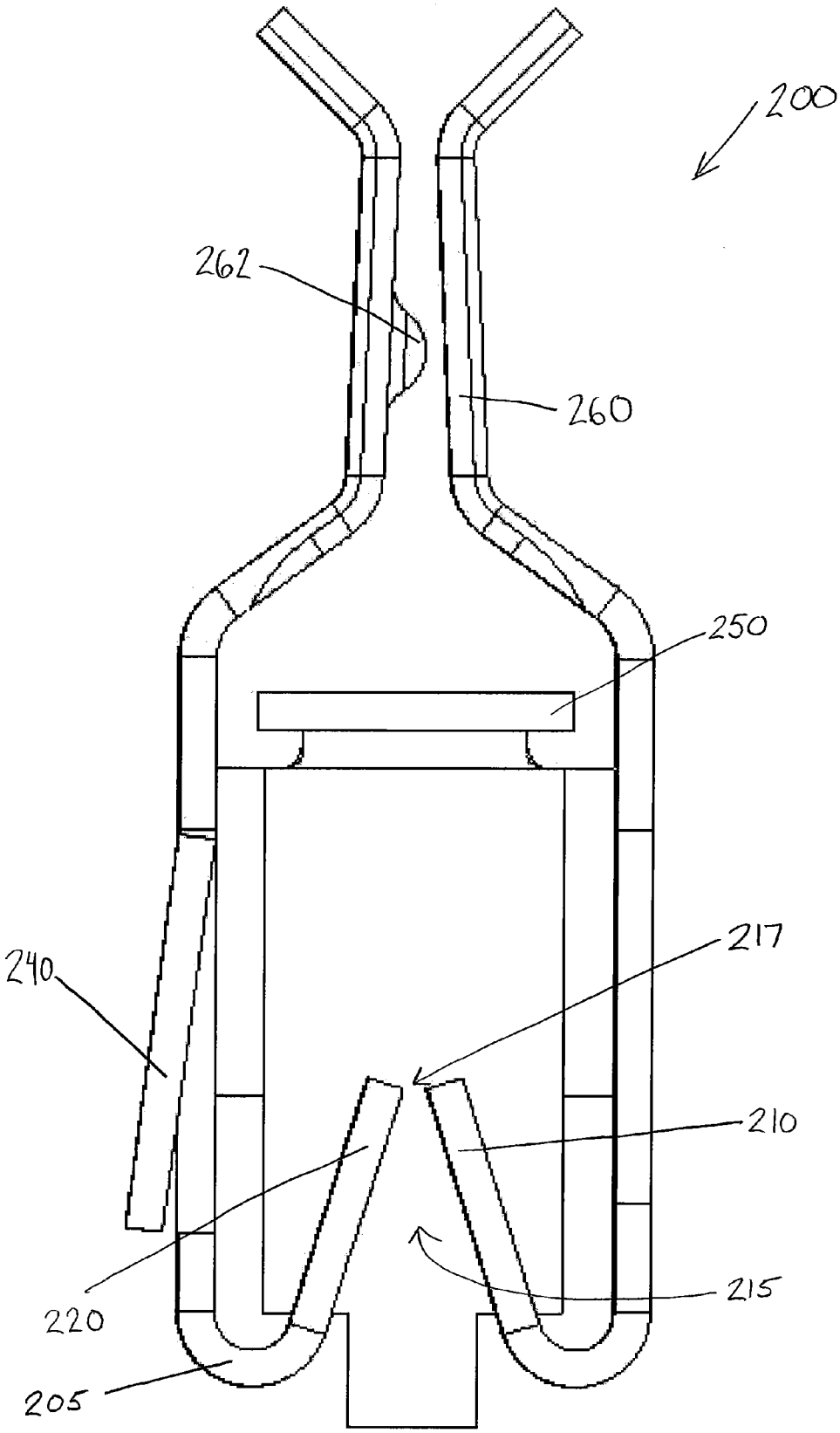
FIG. 6 illustrates a plan view of the contact of FIG. 4.

Turning to FIG. 6, the contact 200 includes a dual-tabbed wire trap 205 comprising a first wire retention tab 210 and a second wire retention tab 220. The wire retention tabs 210, 220 are biased at an angle toward one another. The angle at which the tabs are disposed forms a funnel or wire guide 215 that directs the wire into and through the tabs 210, 220 at an apex 217 of the wire guide 215. When a stripped wire 400 (FIGS. 7*a* and 7*b*) is inserted between the retention tabs 210, 220, the wire is in physical and electrical contact with both tabs 210, 220 at the apex 217.

Figure 7A:
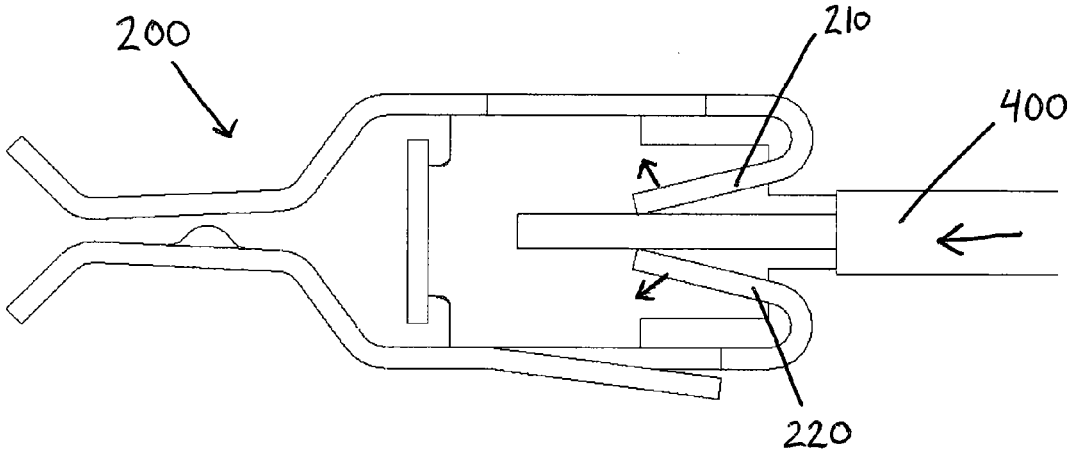
FIGS. 7*a* and 7*b* illustrate a wire in the wire trap and associated directional forces.
Figure 7B:
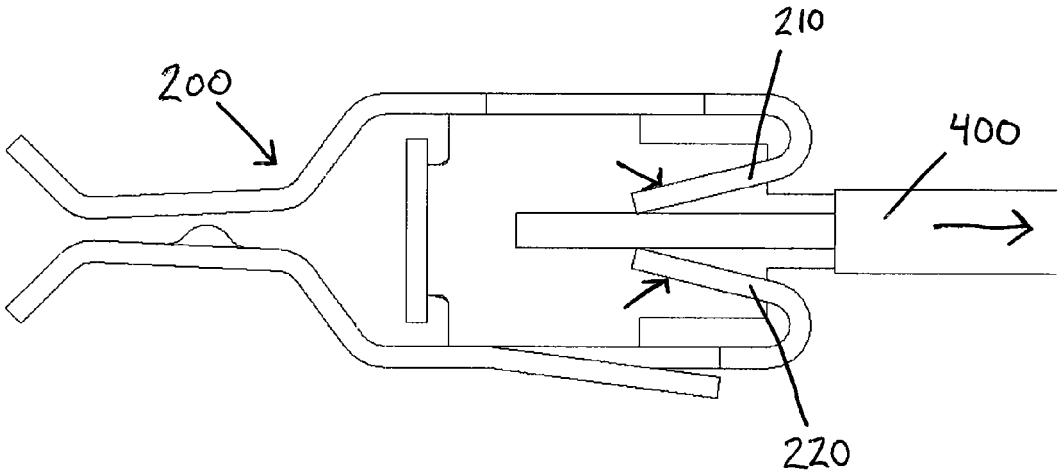

The tabs 210, 220 are angled and spaced such that inserting the wire 400 exerts a force on the tabs 210, 220 urging them away from one another, creating or widening a gap between them, thus permitting the wire 400 to pass into the wire trap 205 of the contact 200 (FIG. 7*a*). Of course, an equal and opposite force is exerted by the tabs 210, 220 on the wire 400, maintaining it in position. Once inserted, attempting to pull the wire back out in an opposite manner has the effect of pulling the tabs 210, 220 in the direction of the wire 400, thereby causing the tabs 210, 220 to squeeze toward one another, exerting a clamping force on the wire 400 that resists the wire's removal (FIG. 7*b*). Thus, the wire 400 can easily be inserted into the contact 200, but once inserted is retained therein and not easily removed.

It will be appreciated that by "wire" is meant both a single wire and wire comprising a plurality of strands of smaller gauge that are typically twisted together in some fashion and tinned to approximate a single wire of larger gauge.

As illustrated in FIG. 6, the contact 200 also includes a prong receptacle portion 260 for receiving a prong or other electrically conductive member that is to be in electrical communication with the wire via the connector 10 and thereby complete an electrical circuit. The prong may be retained in the contact 200 by a nubbin 262 protruding from the contact receptacle portion 260 and urging the prong against an inner side wall of the contact 200 or engaging a detent or aperture in the inserted prong. Alternatively, for example, the prong receptacle portion 260 could include a detent to receive a nubbin extending from the inserted prong. Thus, it will be appreciated that various arrangements for retaining the prong in the contact 200 are contemplated.

The contact 200 is illustrated with a single dual-tabbed wire trap 205 and an oppositely disposed prong receptacle portion 260. However, depending on the configuration of the electrical devices to be connected via the connector 10, it will be appreciated the prong receptacle portion 260 could be substituted with a second set of dual wire retention tabs 210, 220 or any other suitable retention means.

Figure 4:
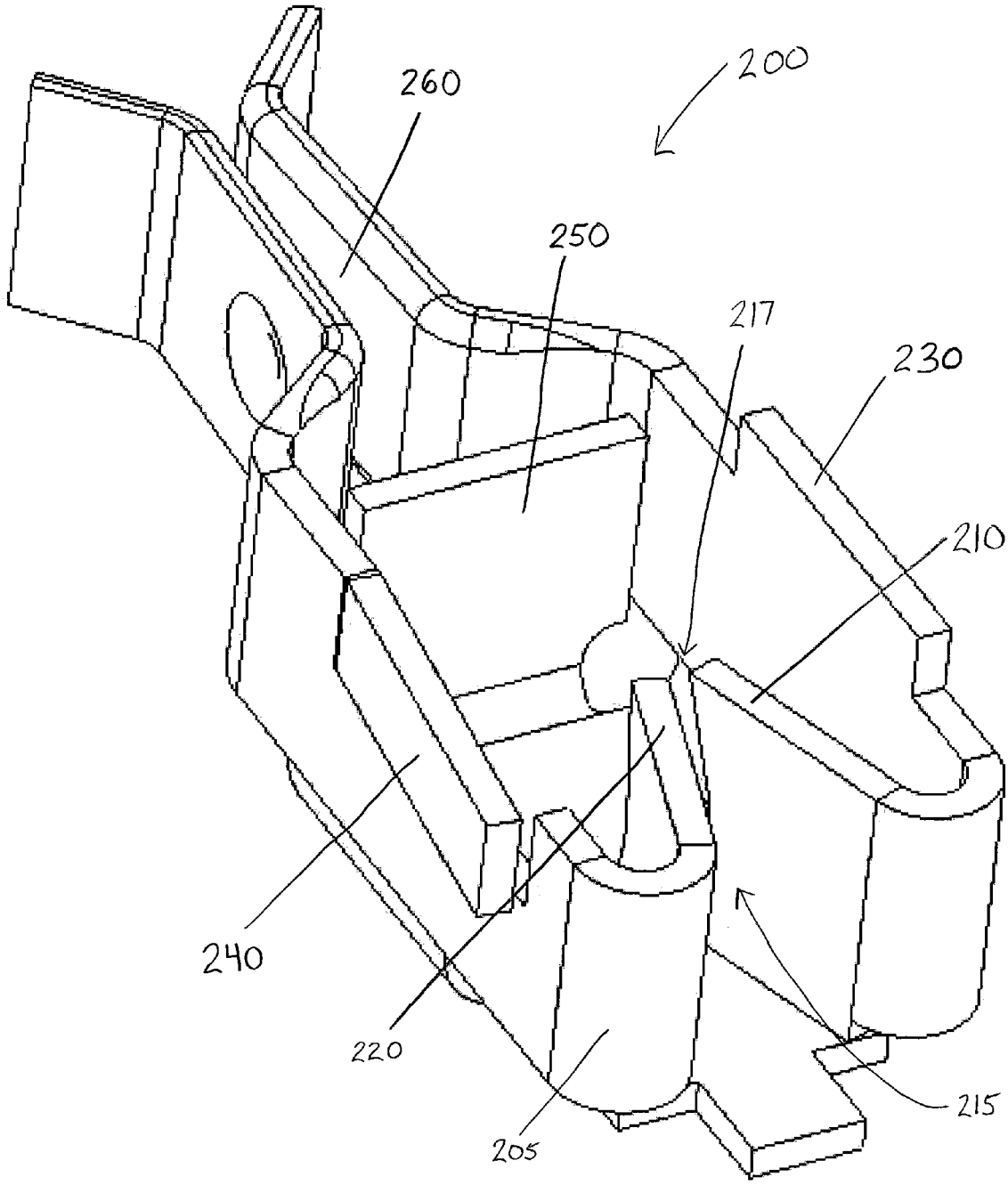
FIG. 4 illustrates an isometric view of a contact having a dual-tabbed wire trap in accordance with an exemplary embodiment of the invention.

As better seen in FIG. 4, the contact 200 may include a wire stop 250 to limit the distance of inward travel of the wire beyond the wire guide apex 217. The wire stop 250 may prevent any insulated portion of the wire from entering the wire trap 205 and may also prevent the wire from extending into the prong receptacle portion 260. The contact 200 may also include a parapet 230 to make it asymmetrical. As will be discussed later, this asymmetry may aid in ensuring that the contact 200 can only be inserted one way into the connector body portion 100 during assembly of the connector 10.

To aid in retention of the contact 200 in the connector body portion 100, it may include a contact retention tab 240 biased away from the main body of the contact 200. Upon insertion of the contact 200 in the connector body portion 100, the contact retention tab 240 exerts a force against the connector body portion 100, retaining it in place.

Figure 5:
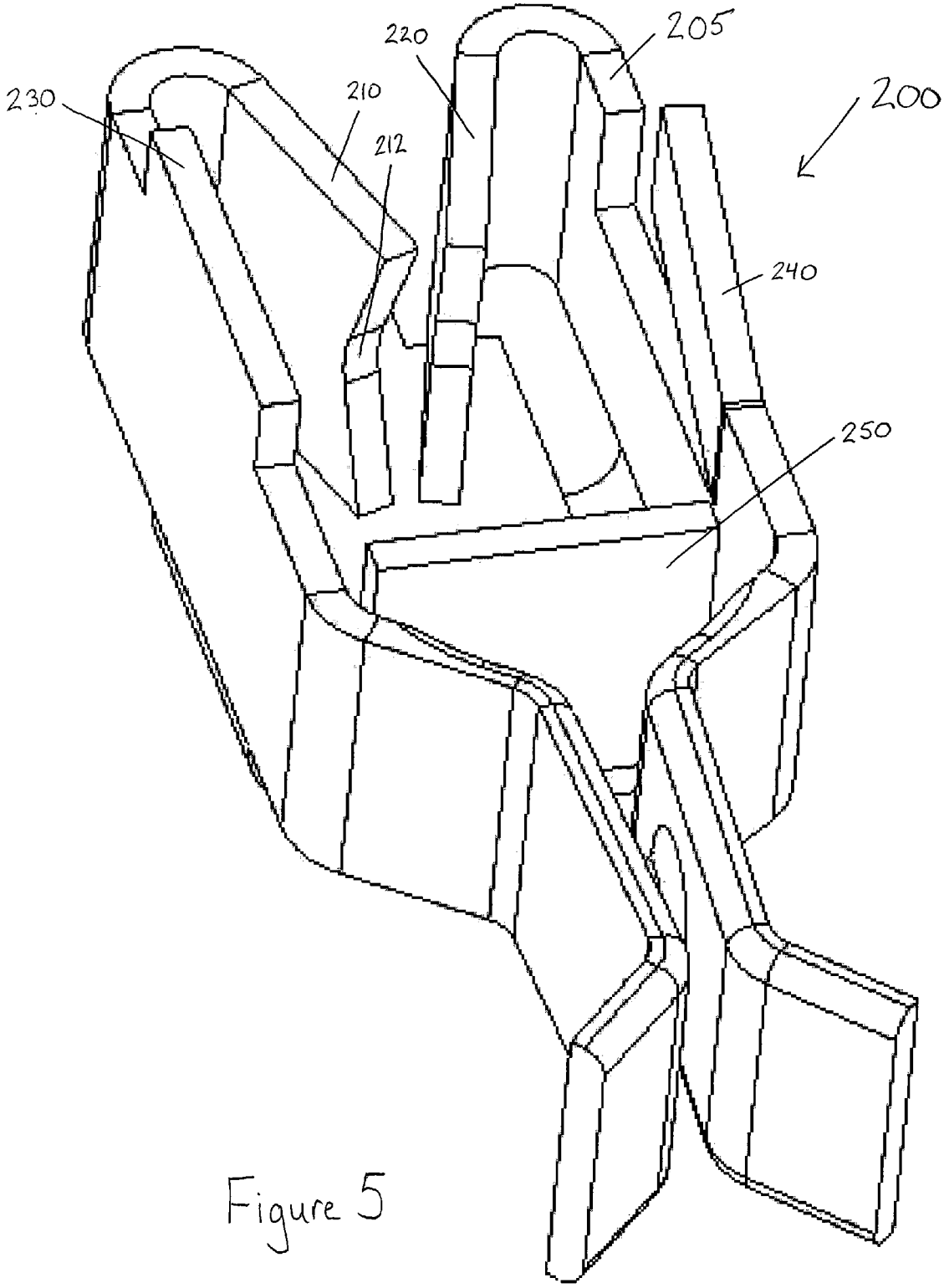
FIG. 5 illustrates an alternate view of the contact of FIG. 4.

As better seen in FIG. 5, one or both of the wire retention tabs 210, 220, may include a centering guide 212, which may be accomplished by imparting an indentation, such as a v-shape, to the apex-forming ends of the tab(s) 210, 220. This may assist in self-centering the wire upon insertion, as well as helping to ensure the wire's retention at that centered location, reducing or preventing lateral motion of the wire, which motion may result in undesired interruptions of electrical communication.

The contact 200 is preferably a unitary piece of conductive material that is stamped and formed to create the desired shape, such as the wire stop 250 or any other features in addition to the dual wire retention tabs 210, 220 that form the wire trap 205.

The contact 200 may be used with any suitable connector body portion 100 to provide a connector 10 for connecting any desired electrical devices. Returning to FIG. 1, the connector 10 is illustrated as a photoelectric connector having a photoelectric connector body portion for connecting a photoelectric cell with a lamp or other solar powered or solar-switched electrical device.

Figure 9:
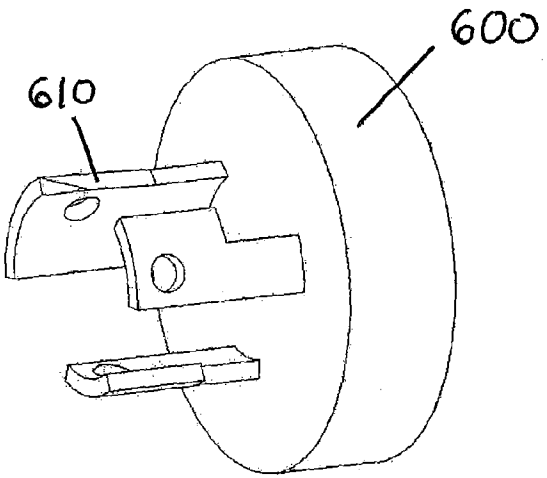
FIG. 9 illustrates a photoelectric cell for use with a photoelectric connector according to an exemplary embodiment of the invention.

The connector body portion 100 is generally cylindrical and includes an annular upper body portion 102 and an annular lower body portion 104 in which the upper body portion 102 has a different diameter than the lower body portion 104. The lower body portion 104 projects away from the upper body portion 102 substantially at a right angle from a plane that includes the top surface 101 of the upper body portion 102. The upper body portion 102 comprises one or more apertures or prong receptacles 120 configured to receive prongs 610 from a photoelectric cell 600 (FIG. 9). The upper body portion 102 may further include orientation indicia 142, such as "north" or a letter "N" that assists a user in positioning the connector 10, and the photoelectric cell connected thereto, at a desired orientation.

Figure 2:
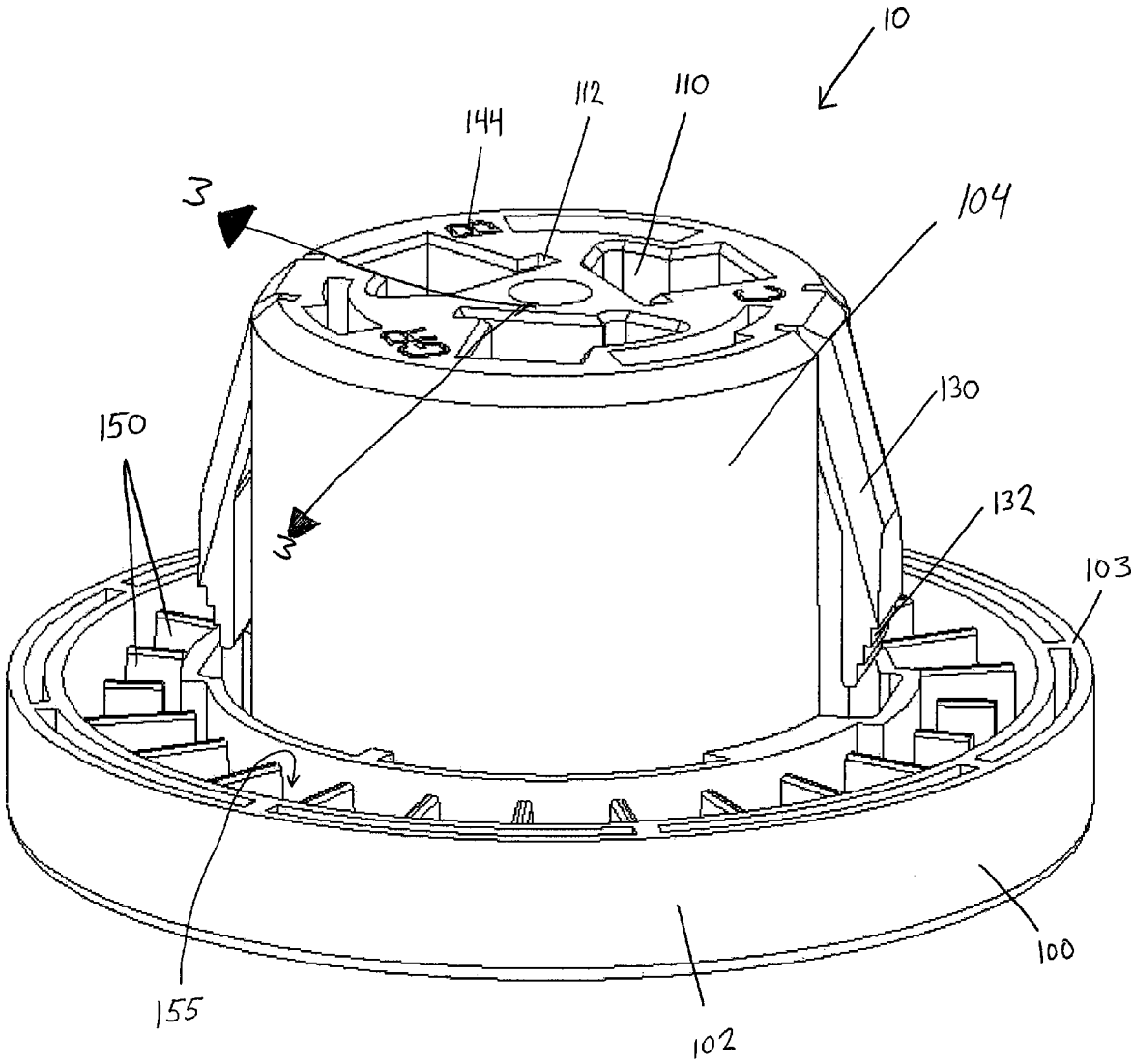
FIG. 2 illustrates the underside of the photoelectric connector of FIG. 1.
Figure 8A:
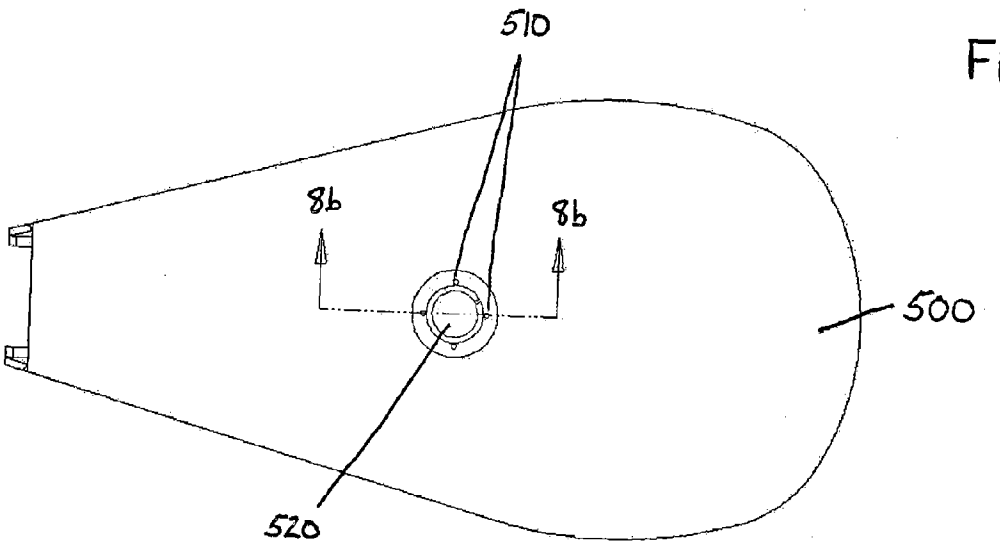
FIGS. 8*a* and 8*b* illustrate a street lamp shade for use with a photoelectric connector according to an exemplary embodiment of the invention.
Figure 8B:
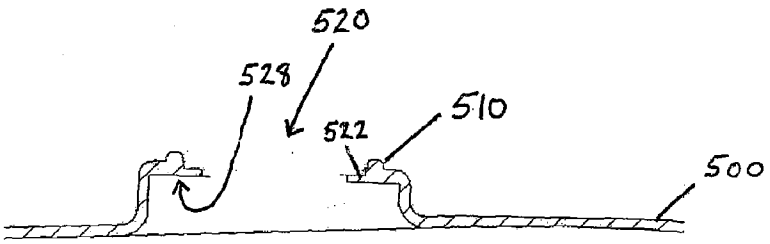

Turning to FIG. 2, the bottom surface 103 of the upper body portion 102 may include a circumferential channel 155 encircling the lower body portion 104. As illustrated, a plurality of flexible fins 150 are disposed radially within the channel 155. The fins 150 are preferably evenly spaced around the channel 155. The distance between fins 150 is sufficiently wide to accommodate one or more corresponding columns or pins 510 extending from the lamp shade 500 (FIGS. 8*a* and 8*b*) to which the connector 10 will be attached, but sufficiently close to prevent substantial rotational motion in the absence of an applied external rotational force.

Typically, the connector body portion 100 is injection molded using an electrically insulative thermoplastic, such as high temperature nylon (HTN) by way of example only, or any other electrically insulative material. As a result, while any geometry fin may be selected, a square or rectangular fin is presently preferred for easier tooling and manufacturing. Furthermore, the thickness and/or the width of the fin 150 may be tapered as the distance from the bottom surface 103 of the upper body portion 102 increases.

Regardless of the geometry of fin selected, for each fin 150, preferably only one side is connected to the connector body portion 100. As a result, and by making the fins 150 sufficiently thin, the fins 150 are flexible enough to deflect when a sufficiently large external rotational force is applied to the connector 10. Thus, once the connector is installed in a lamp shade or other electrical device, the flexible fins 150 prevent free rotation of the connector 10. However, they also easily permit the orientation of the connector 10 to be adjusted by simply twisting it, avoiding the need to remove or lift and realign the connector 10 in a new position.

The lower body portion 104 comprises at least one contact receptacle 110. The contact receptacle 110 and the prong receptacle 120 in the upper body portion 102 define a single aperture extending through the connector 10, although the geometry of that aperture may vary along its length. At least one contact 200 is inserted into the contact receptacles 110. The contact receptacles 110 are configured to receive and house the contact 200 in the assembled connector 10. Each contact receptacle 110 is electrically isolated from any adjacent contact receptacles.

If the contact 200 includes a parapet 230 or other feature to impart a polarity for single direction assembly, the contact receptacles 110 are similarly configured with a parapet receptacle portion 112 to match the asymmetry of the contact 200. The lower body portion 104 typically includes connection indicia 144 which may assist a user in proper wiring by ensuring that certain wires are inserted into appropriate corresponding contacts 200 of the connector 10 for proper operation of the electrical devices with which the photoelectric connector 10 is used.

Figure 3:
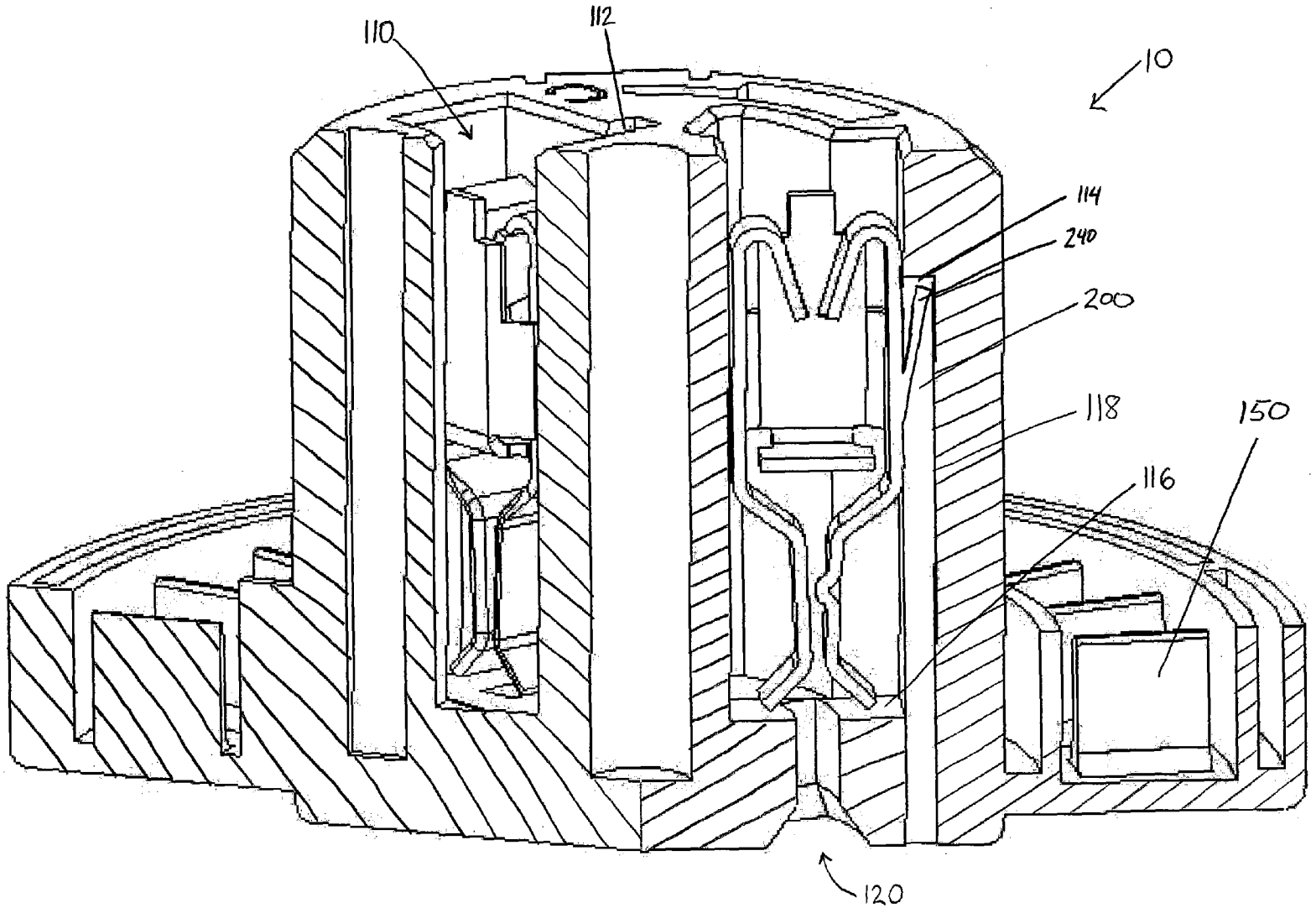
FIG. 3 illustrates a cross-sectional view of the photoelectric connector illustrated in FIG. 2.

As seen better in FIG. 3, which shows a cross-sectional view of FIG. 2 taken across line 3—3, the connector 10 is shown with contacts 200 retained in the contact receptacles 110. The contacts 200 may be held in the contact receptacles 110 by friction force between the inner walls of the contact receptacles 110 and the outer walls of the contact 200. As discussed above, however, the contacts 200 may be provided with a contact retention tab 240 biased away from the main body of the contact 200. In combination with the use of a contact retention tab 240, the contact receptacle 110 may include a staggered inner wall 118 to provide a contact retention ledge 114. During insertion, after the contact retention tab 240 clears the retention ledge 114, the force countering the contact retention tab 240 provided by the inner wall 118 of the contact receptacle 110 is removed and the contact retention tab 240 returns to its biased position. This prevents the contact 200 from exiting the contact receptacle 110 without significant difficulty and/or breaking the connector 10 unless a special tool is removed. An interface ledge 116 at the interface of the prong receptacle 120 and the contact receptacle 110 serves as a travel stop for the contact 200 within the contact receptacle 110 in the opposite direction.

The connector body portion 100 includes an integral connector retention system which avoids the need to use a separate retainer clip found with other photoelectric connectors. Returning to FIG. 2, the connector retention system is illustrated as a plurality of retention tabs 130 integral with, but extending from, the lower body portion 104. The retention tabs 130 are biased away from the main body of the lower body portion 104.

Thus, when the lower body portion 104 is inserted into an aperture 520 of a street lamp shade 500 (FIGS. 8*a* and 8*b*), the retention tabs 130 are compressed by walls 522 of the lamp shade 500 forming the aperture 520 and the retention tabs 130 easily pass through the aperture 520. Once through the aperture 520, the walls 522 no longer provide a force to counter the bias of the retention tabs 130. As a result, the bias causes the retention tabs 130 to return to their original position and the connector 10 snaps into a retained position. The retention tabs 130 may be further retained by engaging a bottom lip 528 of the aperture 520 in the street lamp shade 500. This further serves to lock the connector 10 in place to substantially prevent axial movement while permitting rotational movement when an external force sufficient to overcome the resistance of the fins 150 is provided as described above.

It may be desirable to use the photoelectric connector 10 with different styles and sizes of street lamp shades or other electric devices. As a result, the retention tabs 130 may be provided with one or more steps 132 to accommodate and engage different sized electrical devices into which the connector 10 is inserted.

While the foregoing specification illustrates and describes exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A connector comprising:

a connector body portion comprising an upper body portion comprising a top surface and at least one prong receptacle extending therethrough, and a lower body portion comprising at least one contact receptacle extending therethrough, the lower body portion projecting away from the upper body portion at substantially a right angle from a plane that includes the top surface of the upper body portion; and at least one conductive contact retained in the contact receptacle comprising a wire trap for receiving and retaining a wire of a first device to be connected to a second device, wherein the connector body portion comprises an integral retention system for retaining the connector in at least one of the first device or the second device, the integral retention system comprising at least one retention tab biased away from the lower body portion for engaging the device in which the connector will be retained, wherein the retention tab comprises a plurality of steps for engaging devices of different size.

2. The connector of claim 1, wherein the wire trap comprises a first wire retention tab and a second wire retention tab, wherein the first wire retention tab and the second wire retention tab are biased toward one another at an angle to form a wire guide, the wire guide configured to contact and receive a wire inserted into the wire trap and wherein the first and second wire retention tabs are configured to impart a clamping force to retain the wire, when inserted, in the wire trap.

3. The connector of claim 1, wherein the connector is configured to engage a photoelectric cell.

4. The connector of claim 1, wherein the contact receptacle and the contact have a corresponding asymmetry.

5. The connector of claim 1, wherein the contact receptacle has a contact retention ledge for engaging a contact retention tab of the contact.

6. The connector of claim 1, wherein the contact comprises a unitary piece of electrically conductive material.

7. The connector of claim 1, wherein the prong receptacle and the contact receptacle define a single aperture extending through the connector.

8. The connector of claim 1, wherein the upper body portion is substantially annular and wherein the upper body portion comprises a circumferential channel in a bottom surface of the upper body portion having a plurality of flexible fins radially disposed therein.

9. The connector of claim 8, wherein the flexible fins are attached to the channel by a single side.

10. A photoelectric device comprising a first electrical device having at least one wire;

a second electrical device comprising a photoelectric cell in electrical communication with the first electrical device; and a connector connecting the first electrical device and the second electrical device, the connector comprising a connector body portion comprising an annular upper body portion having a top surface and at least one prong receptacle extending therethrough and a circumferential channel in a bottom surface of the upper body portion, the channel having a plurality of flexible fins radially disposed therein, and an annular lower body portion comprising at least one contact receptacle extending therethrough, the lower body portion projecting away from the upper body portion at substantially a right angle from a plane that includes the top surface of the upper body portion; and at least one contact retained in the contact receptacle, the contact comprising a wire trap having a first wire retention tab and a second wire retention tab, wherein the first wire retention tab and the second wire retention tab are biased toward one another at an angle to form a wire guide configured to contact, receive and retain the wire of the first electrical device in the wire trap and wherein the connector body portion comprises at least one integral retention tab configured to retain the connector in at least one of the first device or the second device.

11. A connector comprising:

a connector body portion comprising an upper body portion comprising a top surface and at least one prong receptacle extending therethrough, and a lower body portion comprising at least one contact receptacle extending therethrough, the lower body portion projecting away from the upper body portion at substantially a right angle from a plane that includes the top surface of the upper body portion; and at least one conductive contact retained in the contact receptacle comprising a wire trap for receiving and retaining a wire of a first device to be connected to a second device, wherein the connector body portion comprises an integral retention system for retaining the connector in at least one of the first device or the second device, wherein the upper body portion is substantially annular and wherein the upper body portion comprises a circumferential channel in a bottom surface of the upper body portion having a plurality of flexible fins radially disposed therein.

12. The connector of claim 11, wherein the flexible fins are attached to the channel by a single side.

13. The connector of claim 11, wherein the contact further comprises a wire stop, wherein the wire stop defines a length of maximum inward travel of a wire to be inserted into the wire trap.

14. The connector of claim 11, wherein the contact is asymmetric.

15. The connector of claim 11, wherein the contact comprises a unitary piece of conductive material.

16. The connector of claim 11, wherein the contact further comprises a prong receptacle portion opposite the wire guide for receiving a prong of a second device to be connected.

17. The connector of claim 11, wherein the wire trap comprises a first wire retention tab and a second wire retention tab, wherein the first wire retention tab and the second wire retention tab are biased toward one another at an angle to form a wire guide, the wire guide configured to contact and receive a wire inserted into the wire trap and wherein the first and second wire retention tabs are configured to impart a clamping force to retain the wire, when inserted, in the wire trap.

18. The connector of claim 17, wherein at least one wire retention tab comprises a centering guide.

* * * * *